US005142190A

United States Patent [19]

Koh

[11] Patent Number: 5,142,190

[45] Date of Patent: Aug. 25, 1992

[54] ELECTRON GUN FOR A COLOR CATHODE-RAY TUBE

[75] Inventor: Nam J. Koh, Kyungsangbook, Rep. of Korea

[73] Assignee: Goldstar Co., Ltd., Seoul, Rep. of Korea

[21] Appl. No.: 616,908

[22] Filed: Nov. 21, 1990

[30] Foreign Application Priority Data

Nov. 21, 1989 [KR] Rep. of Korea ..... 16892/1989

[51] Int. Cl.[5] ..... H01J 29/54

[52] U.S. Cl. ..... 313/414; 313/412; 313/413; 313/449; 315/16

[58] Field of Search ..... 313/414, 412, 413, 449; 315/15, 16, 368

[56] References Cited

U.S. PATENT DOCUMENTS

| | | | |
|---|---|---|---|
| 4,591,760 | 5/1986 | Kimura | 315/16 |
| 4,935,663 | 6/1990 | Shimoma et al. | 313/412 |
| 5,023,508 | 6/1991 | Park | 313/414 |

*Primary Examiner*—Donald J. Yusko

*Assistant Examiner*—Ashok Patel

*Attorney, Agent, or Firm*—Birch, Stewart, Kolasch & Birch

[57] ABSTRACT

An electron gun for a color cathode-ray tube includes a triode, a pre-stage auxiliary electrostatic focusing lens, a fourth grid electrode, a first accelerating/focusing lower electrode assembly, and a main electrostatic focusing lens formed between a first accelerating/focusing upper electrode assembly and a second accelerating-/focusing electrode. In the electron gun, the electron beam horizontally extended by the magnetic quadrupole lens of the deflection magnetic field is compensated by vertically extending the horizontally extended electron beam before the deflection magnetic field is entered by the electrostatic quadrupole lens which varies according to the deflected amount of the electron beam and round beam sports obtained in the vicinity of the screen edge as well as at the center of the screen, so that the halo portions of a low electron density surrounding the core portion of a high electron density forming a beam spot is greatly reduced to obtain a good resolution characteristic.

3 Claims, 2 Drawing Sheets

ELECTRON GUN FOR A COLOR CATHODE-RAY TUBE

THE INVENTION

1. Field of the Invention

The present invention relates to an electron gun for a color cathode-ray tube and more particularly, to an electron gun for a color cathode-ray tube having an electrode structure for forming a dynamic quadrupole electrostatic lens which varies according to the amount of an electron beam deflected by the deflection yoke of the color cathode-ray tube so as to secure good spot characteristics of the electron beam all over the screen and have a multi-stage focusing means.

2. Description of the Prior Art

An electron gun for a conventional color cathode-ray tube, in general, has a plurality of grid electrodes integrated in a tubal axis direction, so-called an "in-line alignment" grid electrode and a predetermined spacing disposed between the plurality of grid electrodes of such conventional color cathode-ray tube kept and fixed by a bead glass wherein each of the plurality of grid electrodes is made of a copper plate having a plurality of electron beam passage holes punched toward the power source in a horizontal in-line manner.

The electron gun including a plurality of grid electrodes integrated one by one as mentioned above, is constructed by a triode for forming an electron beam from the thermal electrons emitted from the cathode and a main electrostatic focusing lens for forming a beam spot on the screen of such color cathode-ray tube by focusing the electron beam to be slender.

The main electrostatic focusing lens is classified as a bi-potential focus (hereinafter "BPF") type and a uni-potential focus (hereinafter "UPF") type according to its construction.

BPF-type main electrostatic focusing lens consists of two electrodes which are called a first accelerating-/focusing electrode and a second accelerating/focusing electrode. A high voltage from 20 kv up to 30 kv is applied to the second accelerating/focusing electrode, and a medium-level high voltage which lays in a 18–28% of the high voltage is applied to the first accelerating/focusing electrode.

UPF-type main electrostatic focusing lens consists of a first accelerating/focusing electrode, a second accelerating/focusing electrode, and an intermediate electrode therebetween. A high voltage is applied to the first and second accelerating/focusing electrodes in common, and nearly a ground voltage is applied to the intermediate electrode.

And also, in recent years, the electron gun which performs a multi-stage focusing has been used in order to secure a better focusing effect according to such conventional color cathode-ray tube in use.

Such electron gun for the color cathode-ray tube has a pre-stage focusing lens for an auxiliary focusing between the triode and the main electrostatic focusing lens.

Generally, for the color cathode-ray tube, as described above, each of all the electrodes of the electron gun integrated one by one has a plurality of electron beam passage holes punched toward the power source.

Accordingly, when the electrons are emitted from the cathode in an operating condition and then passed through the electron beam passage holes, the electrons from the electron beam is symmetrical with respect to the central axis of their revolutions. Continuously, the electron beam passed through the electron beam passage holes, according to the Lagrange's refraction law, is focused axis-symmetrically in the axis-symmetrical electric field and becomes round when leaving the electron gun.

When the electron beam which has not been affected by the deflection yoke (hereinafter "DY") reaches the center of the color cathode-ray tube screen, it is focused roundly and finely to form a small and round beam spot on the screen. A predetermined section as a deflection area (not shown) toward the screen is formed in the color cathode-ray tube by DY which is mounted on the outside of the color cathode-ray tube. In the vicinity of the electron gun exit, the electron beam which has left the electron gun is scanned all over the screen by the deflection magnetic field of the deflection area to reproduce a picture.

Since the magnetic field derived from DY has to play to converge a plurality of electron beams at a point on the screen, a so-called self-convergence system is chosen so that an electron beam is emitted from the electron gun for the color cathode-ray tube in a horizontal in-line manner. The deflection magnetic field derived from the deflection yoke is a non-uniform magnetic field in which the intensity of its central portion is different from one of its edge portion.

FIG. 3 shows the motion of the electron beam due to the non-uniform deflection magnetic field for achieving the above-mentioned self convergence with an example of a horizontal deflection magnetic field. That is, the non-uniform horizontal deflection magnetic field moves the entire electron beam to the right.

Since every different component of the magnetic field is exerted on every portion of the electron beam, the top and bottom portions of the electron beam are compressed by a magnetic force and the left and right portions of the electron beam are extended by the magnetic force.

Accordingly, in practice, when the electron beam has passed through the deflection area by the magnetic quadruple lens, the scanning of the electron beam is conducted in the light of the entire electron beam and, at the same time, the electron beam appears distorted in a horizontally extended form.

Returning again to the electron gun, the electron beam which has passed through the electron beam passage holes of the grid electrodes integrated one by one along the tubular axis from the front of the cathode is focused round and slender and leaves the end of the electron gun to continue to travel toward the deflection area.

Accordingly, the original round electron beam is distorted in a horizontally extended form by the magnetic quadruple lens of the non-uniform deflection magnetic field derived from the deflection yoke.

The electron beam which has reached the screen of the color cathode-ray tube forms a beam spot which includes a horizontally extended core portion having a high electron density and a halo portion having a low electron density around the core portion.

Such a horizontally extended phenomenon of the electron beam due to the non-uniform deflection magnetic field becomes more noticeable as the electron beam is deflected further from the center of the screen since the intensity of the non-uniform deflection magnetic field gets stronger when going further from the center of the screen.

In addition to such a phenomenon, another phenomenon is that a focus locus of the electron beam and a distance difference up to the screen are made bigger when moving toward the screen edge lead to a great deterioration of the color cathode-ray tube screen resolution since the core portion of the beam spot appeared on the screen becomes more slender and the halo portion having a low electron density around the core portion becomes bigger when moving further toward the screen edge.

In order to remove the slender and horizontally extended core around the screen edge of the color cathode-ray tube, and the halo made at the top and bottom portions of the core and having a low electron density, a method has been proposed, which makes the electron beam horizontally extend before entering the main electrostatic focusing lens of the electron gun and again makes the horizontally extended electron beam go through a magnetic field and extend vertically when entering the deflection area after passing through the axis-symmetrical lens of the main electrostatic focusing lens. Therefore, a plurality of horizontally long electron beam passage holes are punched in one electrode of the triode.

Even though the aberration due to the non-uniform deflection magnetic field can be removed to a certain extent, a bold and vertically extended core appears on the screen center because the beam spot is emitted from the electron gun on which any magnetic field is ineffective.

Accordingly, the conventional electron gun for the color cathode-ray tube has a number of problems such as, for example, when considering the entire color cathode-ray tube, its good screen characteristic cannot be obtained and also, the halo components around the screen edge corresponding to the electron beam focus locus and a distance difference up to the screen cannot be completely removed.

SUMMARY OF THE INVENTION

Accordingly, it is an object of the present invention to provide an electron gun for a color cathode-ray tube which eliminates the above-mentioned problems encountered in a conventional electron gun.

Another object of the present invention is to provide an electron gun for a color cathode-ray tube, which comprises a triode including a cathode and first and second grid electrodes, a pre-stage auxiliary electrostatic focusing lens including third and fourth grid electrodes and a lower electrode of a first accelerating-/focusing lower electrode assembly, a main electrostatic lens mounted between an upper electrode of the first accelerating/focusing lower electrode assembly and a second accelerating/focusing electrode, at the same time, a quadrupole lens disposed between the pre-stage auxiliary electrostatic focusing lens and main electrostatic focusing lens by placing a horizontal partition electrode of a first accelerating/focusing lower electrode assembly, an intergrid electrode assembly, and a horizontal partition electrode of a first accelerating/focusing upper electrode assembly.

Other objects and further scope of applicability of the present invention will become apparent from the detailed description given hereinafter. It should be understood, however, that the detailed description and specific examples, while indicating preferred embodiments of the invention, are give by way of illustration only, since various changes and modifications within the spirit and scope of the invention will become apparent to those skilled in the art from this detailed description.

Briefly described, the present invention relates to an electron gun for a color cathode-ray tube which comprises a triode, a pre-stage auxiliary electrostatic focusing lens, a fourth grid electrode, a first accelerating-/focusing lower electrode assembly, and a main electrostatic focusing lens formed between a first accelerating-/focusing upper electrode assembly and a second accelerating/focusing electrode, in the electron gun, the electron beam horizontally extended by the magnetic quadrupole lens of the deflection magnetic field is compensated by vertically extending the horizontally extended electron beam before the deflection magnetic field is entered by the electrostatic quadruple lens which varies according to the deflected amount of the electron beam and round beam spots obtained in the vicinity of the screen edge as well as at the center of the screen, so that the halo portions of a low electron density surrounding the core portion of a high electron density forming a beam spot is greatly reduced to obtain a good resolution characteristic.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
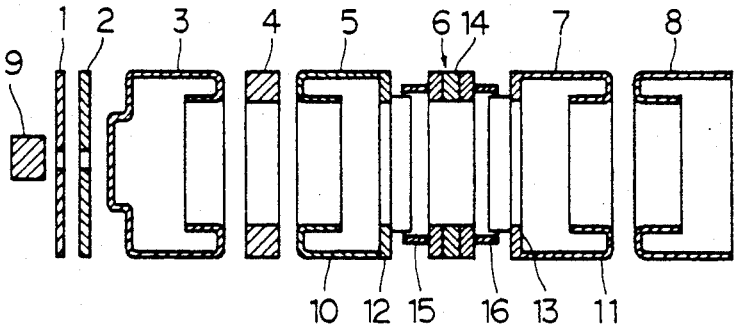
FIG. 1 is a longitudinal sectional view of the electron gun for a color cathode-ray tube according to the present invention.
Figure 2A:
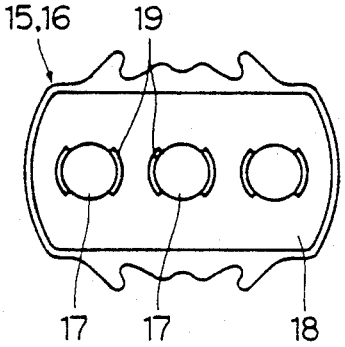
FIG. 2A is a plan view of a vertical partition electrode of the electrostatic quadrupole lens configuration according to the present invention.
Figure 2B:
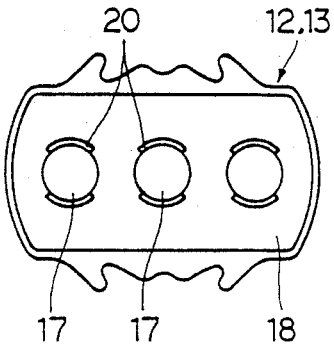
FIG. 2B is a plan view of a horizontal partition electrode of the electrostatic quadrupole lens configuration according to the present invention.

Referring now in detail to the drawings for the purpose of illustrating preferred embodiments of the present invention, the electron gun for a color cathode-ray tube as shown in FIGS. 1, 2A and 2B, comprises a first grid electrode 1, a second grid electrode 2; a third grid electrode 3, a fourth grid electrode 4, a first accelerating/focusing lower electrode assembly 5, an intergrid electrode assembly 6, a first accelerating-/focusing upper electrode assembly 7, a second accelerating/focusing electrode 8, and a cathode 9.

A triode includes the cathode 9, the first grid electrode 1, and the second grid electrode 2, an auxiliary pre-stage electrostatic focusing lens built by the third grid electrode 3, the fourth grid electrode 4 and the lower electrode 10 of the first accelerating/focusing lower electrode assembly 5; and a main electrostatic focusing lens disposed between the upper electrode 11 of the first accelerating/focusing upper electrode assembly 7 and the second accelerating/focusing electrode 8.

At the same time, a horizontal partition electrode 12 of the first accelerating/focusing lower electrode assembly 5, the intergrid electrode assembly 6 and a horizontal partition electrode 13 of the first accelerating-/focusing upper electrode assembly 7 in turn arranged to play a role as an electrostatic quadrupole lens between the pre-stage auxiliary electrostatic focusing lens and main electrostatic focusing lens.

And also, the intergrid electrode assembly 6 has a structure that vertical partition electrodes 15 and 16 are mounted before and after the intermediate electrode 14 made of a plate which has a plurality of electron beam passage holes punched in.

The electrostatic quadrupole lens has a structure that the vertical partition electrode 15 at the side of the pre-stage electrostatic focusing lens of the intergrid electrode assembly 6 and the horizontal partition electrode 12 of the first accelerating/focusing lower electrode assembly 5 are in an opposite direction to the vertical partition electrode 16 at the side of the main electrostatic focusing lens of the electrode assembly 6, and the horizontal partition electrode 13 of the first accelerating/focusing upper electrode assembly 7 and their plurality of partitions 19, 20 are arranged to be engaged with each other without any mutual contact.

FIG. 2A is a plan view of the vertical partition electrodes 15, 16 of the above-mentioned intergrid electrode assembly 6. As shown in FIG. 2A, the respective vertical partition electrodes have a plurality of electron beam passage holes 17 as well as two longitudinal partitions 19 wherein one partition 19 on the left and the other partition 19 on the right of the respective electron beam passage holes 17 are disposed on the plate electrode 18 adjoined with the respective electron beam passage holes 17.

FIG. 2B is a plan view of the above-mentioned horizontal partition electrode 12 of the first accelerating-/focusing lower electrode assembly 5 and horizontal partition electrode 13 of the first accelerating/focusing upper electrode assembly 7.

As shown in FIG. 2B, the respective horizontal partition electrodes have the plurality of electron beam passage holes 17 as well as two lateral partitions 20 wherein one partition 20 at the top and the other partition 20 at the bottom of the respective electron beam passage holes 17 are disposed on the plate electrode 18 adjoined with the respective electron beam passage holes 17.

And also, electrode portions for the electrostatic lens formation include the pre-stage auxiliary focusing electrostatic lens, the electrostatic quadrupole lens and the main electrostatic focusing lens of the electron gun for the color cathode-ray tube. The electrical wiring of the electrode portions for the electrostatic lens formation are shown in FIGS. 5 and 6.

Figure 5:
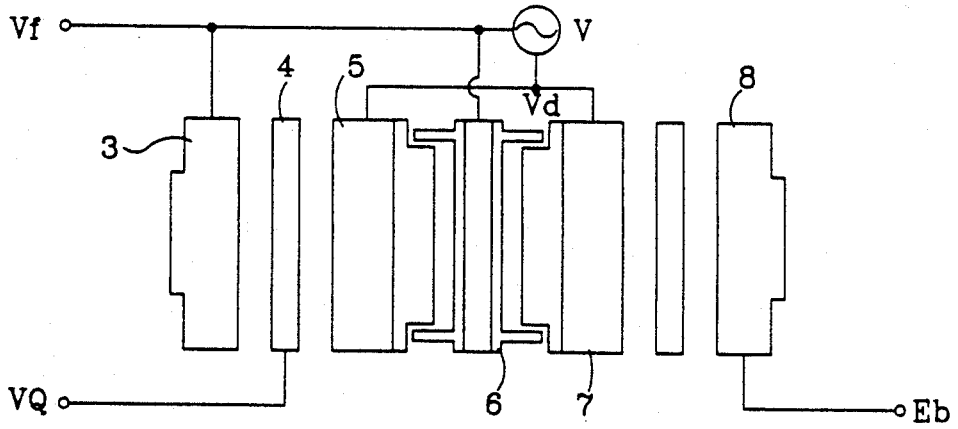
FIG. 5 is an embodiment of electrical wiring for applying power source to the electrostatic lens section in the electron gun for the color cathode-ray tube of FIG. 1.

FIG. 5 shows one embodiment of the present invention. As shown in FIG. 5, a high voltage Eb from 20 kv up to 40 kv is applied to the second accelerating/focusing electrode 8, an intermediate high voltage Vf as much as 20%-30% of the high voltage Eb is commonly applied to the third grid electrode 3 and the intergrid electrode assembly 6; a dynamic focusing voltage Vd which is a constant intermediate direct high voltage Vf superposed on the alternate power source V that varies in proportion to the amount of electron beam deflected on the screen and then commonly applied to the first accelerating/focusing lower electrode assembly 5 and the first accelerating/focusing upper electrode assembly 7, and a relatively low voltage VQ or a second grid voltage is applied to the fourth grid electrode 4.

Figure 6:
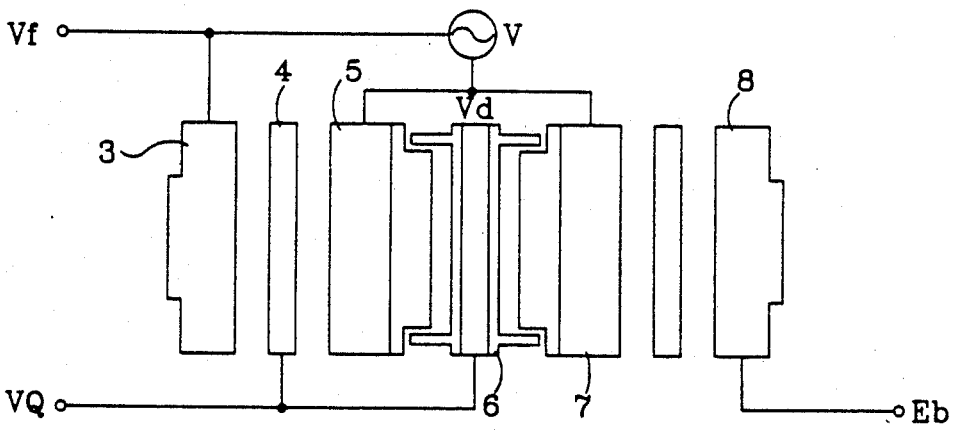
FIG. 6 shows another embodiment of electrical wiring for applying power source to the electrostatic lens section in the electron gun for the color cathode-ray tube of FIG. 1.

FIG. 6 shows another embodiment of the present invention. As shown in FIG. 6, the high voltage Eb from 20 kv up to 40 kv is also applied to the second accelerating/focusing electrode 8; the relatively low voltage VQ or the second grid voltage is applied to the intergrid electrode assembly 6; the intermediate high voltage 14 as much as 20%-30% of the high voltage Eb is applied to the third grid electrode 3; and the dynamic focusing voltage Vd which the constant intermediate direct high voltage Vf is superposed on the alternate power source V that gradually increases or decreases in proportion to the amount of the electron beam deflected on the screen is commonly applied to the first accelerating/focusing lower electrode assembly 5 and the first accelerating/focusing upper electrode assembly 7.

As described above, in the electron gun for the color cathode-ray tube having the electrode structures and electrical focusing relationship, UPF-type pre-stage auxiliary focusing electrostatic lens is formed by the third grid electrode 3, the fourth grid electrode 4 and the first accelerating/focusing lower electrode assembly 5. BPF-type main electrostatic focusing lens is formed by the first accelerating/focusing upper electrode assembly 7 and second accelerating/focusing electrode 8.

In the above-mentioned quadrupole electrostatic lens formation electrode, the dynamic focusing voltage Vd becomes the same as the constant direct intermediate voltage when a deflection current is zero, that is, when the alternate power source 7 becomes zero. The constant intermediate direct high voltage Vf increases according to the deflection current increase, that is, the increase in the amount of the electron beam deflected from the screen center to a position on the screen when the motion of the electron beam is toward the screen edge.

Accordingly, only axis-symmetrical pre-stage auxiliary electrostatic focusing lens and main electrostatic focusing lens participate in forming a round beam spot on the screen center since the vertical partition electrodes 15 and 16 and horizontal partition electrodes 12 and 13 have the same voltage so that an electrostatic lens electric field is not formed therebetween in case that the beam spot is positioned at the center of the screen.

In the meantime, in case that the dynamic focusing voltage Vd increases according to the increase in the electron beam deflection, a potential difference is made between the vertical partition electrodes 15 and 16 and the horizontal partition electrodes 12 and 13 so that an electrostatic quadrupole lens electric field is generated therebetween with respect to the respective electron beam passage holes 17.

Figure 4:
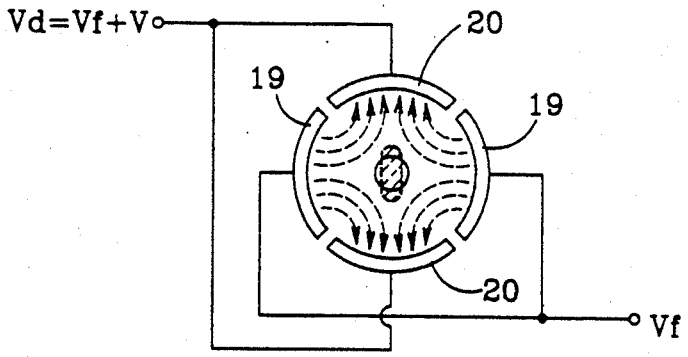
FIG. 4 shows the motion and effect of the electron beam by means of the electrostatic quadrupole lens according to the present invention.

FIG. 4 shows how the electrostatic quadrupole lens electric field generated as mentioned above affects the electron beam passing through the same wherein the dotted arrows denote equipotential lines.

Figure 3:
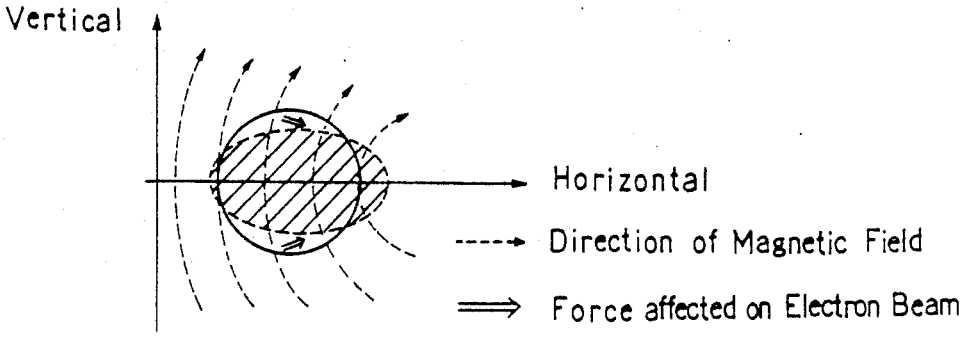
FIG. 3 shows the motion of a electron beam in the horizontal deflection pin cushion magnetic: field for self-convergence which is one of non-uniform deflection magnetic fields according to the present invention.

Since the electron beam passing through the electron beam passage holes 17 under the above-mentioned electrostatic quadrupole lens electric field is affected by an electric force diverging in the vertical direction and ar electric force converging in the horizontal direction, the originally incident round electron beam becomes a horizontally extended ellipsoid as indicated in slanted lines in FIG. 3 where the focus distance of the vertical direction is different from that of the horizontal direction.

The shape of the electron beam is indicated as a full-line circle in FIG. 3 when the alternate power source V is zero.

And also, in case that the dynamic focusing voltage Vd gradually increasing according to the amount of the deflected electron beam is applied to the first accelerating/focusing upper electrode assembly 7 and the first accelerating/focusing lower electrode assembly 5 mounted the horizontal partition electrodes 12 and 13. A lens role of the main electrostatic focusing lens is made weaker according to the deflected amount of the electron beam to make the focus distance of the electron beam longer since the ratio (Vd/Eb) of the voltages Vd and Eb applied to the electrodes, which organizes the main electrostatic focusing lens increases in proportion to the dynamic focusing voltage Vd so that the focus locus of the main electrostatic focusing lens is always formed near the screen of the color cathode-ray tube even though the position of the electron beam goes to the screen of the color cathode-ray tube due to the increase in the deflected amount of the electron beam.

In the electron gun for the color cathode-ray tube, the electron beam horizontally extended by the magnetic quadrupole lens of the deflection magnetic field is compensated by vertically extending the horizontally extended electron beam in advance before entering the deflection magnetic field by the electrostatic quadrupole lens which varies according to the deflected amount of the electron beam so that the round beam spots can be obtained in the vicinity of the screen edge as well as at the center of the screen.

The phenomenon that the electron beam focus locus generated from a general electron gun and a distance difference up to the screen of the color cathode-ray tube become bigger as the screen edge is approached closer is also compensated with a longer focus length of the focusing electron beam attributed to the weakened lens role of the main electrostatic focusing lens additionally generated when the dynamic quadrupole electrostatic lens is formed, thereby accurately reaching the screen of the color cathode-ray tube.

Accordingly, the halo portions of a low electron density surrounding the core portion of a high electron density forming a beam spot is greatly reduced to obtain a good resolution characteristic.

And also, as a constant direct voltage applied to the intergrid assembly 6 of the electrodes constituting the electrostatic quadrupole lens, an intermediate high voltage VF is used in FIG. 5 and the relatively low voltage VQ is used in FIG. 6.

The characteristic of the electrostatic quadrupole lens varies according to a voltage applied to it as well as a geometric structure of the formed electrodes, that is, the length of the longitudinal partition 19 and the lateral partition 20, an overlapped amount of the longitudinal partition 19 and the lateral partition 20, and a total length of the intergrid electrode assembly 6.

Accordingly, the characteristic of the electrostatic quadrupole lens can be optimized even though the applied voltage varies in accordance with a combination of the geometric parameters.

The electron beam emitted from the electron gun for the color cathode-ray tube forms beam spots on the screen which the halo portions of a low electron density surrounding the core portion of a high electron density are greatly reduced so that a good resolution characteristic can be obtained.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An electron gun for a color cathode ray tube, comprising:

a triode including a cathode, a first grid electrode, and a second grid electrode, a pre stage auxiliary electrostatic focusing lens having a third grid electrode, a fourth grid electrode, and a first accelerating/focusing lower electrode assembly, said first accelerating/focusing lower electrode assembly including a lower electrode with a first open end directed away from said triode and a first horizontal partition electrode connected to said first open end of said lower electrode of said first accelerating/focusing lower electrode assembly;

a main electrostatic focusing lens having a first accelerating/focusing upper electrode assembly, said first accelerating/focusing upper electrode assembly including an upper electrode with a first open end directed away from said triode and a second horizontal partition electrode connected to said first open end of said upper electrode;

said main electrostatic focusing lens also having a second accelerating/focusing electrode located close to said second horizontal partition electrode; and an upper electrostatic quadrupole lends having an intergrid electrode assembly, said intergrid electrode assembly including a first vertical partition electrode, a second vertical partition electrode an intermediate plate electrode, wherein said intermediate plate electrode is inserted between said first and second vertical partition electrodes;

said pre-stage auxiliary electrostatic focusing lens, said main electrostatic focusing lens and said upper electrostatic quadrupole lens are located such that said first vertical partition electrode is close to said first horizontal partition electrode and said second vertical partition electrode is close to said second vertical partition electrode;

said intergrid electrode assembly also including a plurality of partitions for said electrodes which are arranged to be separately engaged with each other.

2. An electron gun of claim 1 wherein a high voltage of 20 kv to 40 kv is applied to said second accelerating-/focusing electrode;

a low voltage is applied to said fourth grid electrode;

a constant intermediate high voltage of as much as 20%-30% of said high voltage is applied to said third grid electrode and the intergrid electrode assembly; and a dynamic focusing voltage which is superimposed on said constant intermediate high voltage on an alternate power source that gradually increases or decreases in proportion to a deflected amount of electron beams is applied to both said first accelerating/focusing lower electrode assembly and said first accelerating/focusing upper electrode assembly.

3. An electron gun of claim 1, wherein a high voltage from 20 kv to 40 kv is applied to said second accelerating/focusing electrode;

a low voltage is applied to both said fourth grid electrode and said intergrid electrode assembly;

a constant intermediate high voltage which is as much as 20%-30% of said high voltage is applied to said third grid electrode; and a dynamic focusing voltage which is superimposed on said constant intermediate high voltage on an alternate power source that gradually increases or decreases in proportion to a deflected amount of electron beams is applied to both said first accelerating/focusing lower electrode assembly and said first accelerating/focusing upper electrode assembly.

* * * * *